US010405672B2

(12) United States Patent
Chiesa et al.

(10) Patent No.: US 10,405,672 B2
(45) Date of Patent: Sep. 10, 2019

(54) NEONATE MEDICAL WRAPS FOR A BABY AND PARENT, AND RELATED METHDOS

(71) Applicant: Saplacor, LLC, La Jolla, CA (US)

(72) Inventors: Mary Chiesa, Brentwood, CA (US); Laney Chiesa, Los Angeles, CA (US); Carin Johnson, Los Angeles, CA (US); Kailey Watson, Los Angeles, CA (US)

( * ) Notice: Subject to any disclaimer, the term of this patent is extended or adjusted under 35 U.S.C. 154(b) by 0 days.

(21) Appl. No.: 15/591,802

(22) Filed: May 10, 2017

(65) Prior Publication Data

US 2018/0325281 A1 Nov. 15, 2018

(51) Int. Cl.

| | |
|---|---|
| ***A47D 13/02*** | (2006.01) |
| ***A45F 3/14*** | (2006.01) |
| ***A41D 1/215*** | (2018.01) |
| ***A45F 3/02*** | (2006.01) |
| ***A45C 13/10*** | (2006.01) |

(52) U.S. Cl.

CPC ..... *A47D 13/025* (2013.01); *A41D 1/215* (2018.01); *A45C 13/103* (2013.01); *A45F 3/02* (2013.01); *A45F 3/14* (2013.01); *A45C 2013/1015* (2013.01); *A45F 2003/025* (2013.01); *A45F 2003/142* (2013.01); *A45F 2003/144* (2013.01)

(58) Field of Classification Search

CPC ..... A47D 13/02; A47D 13/025; A47D 1/215; A47D 13/04; A47D 2400/482

USPC ..... 224/158–160

See application file for complete search history.

(56) References Cited

U.S. PATENT DOCUMENTS

| | | | | |
|---|---|---|---|---|
| 2,237 | A | 9/1841 | Cook | |
| 336,413 | A | 2/1886 | Karp | |
| 3,023,419 | A * | 3/1962 | Zurbaran | A41D 13/0017 2/115 |
| 3,229,873 | A | 1/1966 | Hershman | |
| 3,443,066 | A | 5/1969 | Weibel | |
| 4,079,467 | A | 3/1978 | Baldwin | |
| 4,089,067 | A | 5/1978 | Valesco | |
| 4,773,102 | A | 9/1988 | Curtis et al. | |
| 4,987,612 | A | 1/1991 | Middleton | |
| 5,946,725 | A | 9/1999 | Shatzkin et al. | |
| 6,065,655 | A | 5/2000 | Parewick | |
| 6,343,727 | B1 | 2/2002 | Leach | |
| 6,434,750 | B1 | 8/2002 | Hunter | |
| 6,443,885 | B1 | 9/2002 | Schuler | |
| 6,918,770 | B2 | 7/2005 | Odiwo | |
| 7,188,372 | B2 | 3/2007 | Stockard | |
| 7,260,852 | B2 | 8/2007 | Sheetz | |

(Continued)

FOREIGN PATENT DOCUMENTS

| | | | |
|---|---|---|---|
| CN | 202588350 | U | 3/2012 |
| CN | 204379553 | U | 12/2014 |

*Primary Examiner* — Adam J Waggenspack

(74) *Attorney, Agent, or Firm* — Buche & Associates, P.C.; John K. Buche; Bryce A. Johnson

(57) ABSTRACT

Disclosed is a neonate medical wrap. In one embodiment, the neonate medical wrap is a wrap-style baby carrier that is particularly useful during the first 28 days after the baby's birth. Generally, the disclosed neonate medical wrap comprises a torso wrap and a shoulder strap. In use, the torso wrap and shoulder strap may be outfitted around the torso of a parent and, via a side opening, a baby may be installed against the parent's skin under the torso wrap. The shoulder strap may be provided over the shoulder of the parent to assist in supporting the baby's weight while standing.

4 Claims, 11 Drawing Sheets

(56) References Cited

U.S. PATENT DOCUMENTS

| | | | | |
|---|---|---|---|---|
| D574,579 | S | 8/2008 | Kang | |
| 7,546,751 | B2 * | 6/2009 | Lutz | A41B 9/00 66/171 |
| D672,137 | S | 12/2012 | Jackson | |
| 8,491,555 | B2 | 7/2013 | Bracci | |
| 8,973,793 | B2 | 3/2015 | Arvan | |
| D742,630 | S | 11/2015 | Mullins | |
| 2006/0206978 | A1 | 9/2006 | Hilton et al. | |
| 2008/0149674 | A1 * | 6/2008 | Hiniduma-Lokuge | A47D 13/025 224/159 |
| 2009/0285872 | A1 | 11/2009 | Labelle | |
| 2013/0168422 | A1 * | 7/2013 | Carbonell | A41D 1/215 224/158 |
| 2013/0291279 | A1 | 11/2013 | Jensen et al. | |
| 2014/0283277 | A1 | 9/2014 | Wilhelm | |
| 2017/0181914 | A1 * | 6/2017 | Kozol | A61H 1/006 |

* cited by examiner

NEONATE MEDICAL WRAPS FOR A BABY AND PARENT, AND RELATED METHDOS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of neonate wraps and related methods.

Background of the Invention

Recent statistics indicate that newborn babies are dropped by parents, midwifes, or hospital staff at a rate of twenty-two (22) times for every nineteen-thousand (19,000) births. Increases in newborn baby illnesses or diseases, like methicillin-resistant *staphylococcus aureus* (MRSA), Vancomycin-resistant enterococci (VRE), and other hospital-acquired infections (i.e., nosocomial infections), have also been reported in recent years. Some have suggested that increased popularity of skin-to-skin newborn care techniques (sometimes called Kangaroo care because of skin-to-skin techniques' resemblance to the marsupials' newborn in-pouch treatment techniques) are to blame for increased baby drops and infections.

Placing the blame of increased use of skin-to-skin techniques on increased newborn disease and increased injury is rational. Skin-to-skin techniques necessarily involve the handoff of newborns between parents and staff, holding of newborns by inexperienced or untrained parents, and contact of the newborn with the sometimes unclean skin of an adult. So, a need exists for improvements to apparatus and related methods for accomplishing skin-to-skin newborn baby care.

DESCRIPTION OF RELATED ART

The prior patent documents that are known can be described as follows:

U.S. Pat. No. 2,237 by Cook circa 1841 shows suspenders for holding pantaloons so that the torso of a wearer is covered;

U.S. Pat. No. 336,413 by Karp circa 1886 discloses a corset is shown to wrap around the torso of a wearer and that features a plurality of connectors;

U.S. Pat. No. 3,229,873 by Hershman circa 1966 discloses a "child carrier;"

U.S. Pat. No. 3,443,066 by Weibel circa 1969 discloses a "heated outdoor garment;"

U.S. Pat. No. 4,079,467 by Baldwin circa 1978 discloses a "parent-child coat;"

U.S. Pat. No. 4,089,067 by Velasco circa 1978 shows a "shirt" for two people in contact;

U.S. Pat. No. 4,773,102 by Curtis et al. circa 1988 discloses an "inner-pocketed two person jacket;"

U.S. Pat. No. 4,987,612 by Middleton circa 1991 discloses a "cape for a nursing mother;"

U.S. Pat. No. 5,946,725 by Shatzkin et al. circa 1999 discloses an "adult infant bonding garment;"

U.S. Pat. No. 6,065,655 by Parewick circa 2000 discloses a "combination baby carrier and seat harness apparatus;"

U.S. Pat. No. 6,343,727 by Leach circa 2002 discloses a "one-piece baby carrier;"

U.S. Pat. No. 6,434,750 by Hunter circa 2002 discloses an "infant carrier covering;"

U.S. Pat. No. 6,443,885 by Schuler circa 2002 discloses a "process for operating an incubator": during Kangaroo Care;

U.S. Pat. No. 6,918,770 by Odiwo circa 2005 discloses an "infant nurturing medical device," where the device enables Kangaroo Care "in the absence of biological parents;"

U.S. Pat. No. 7,188,372 by Stockard circa 2007 discloses an "infant-supporting privacy nursing apron;"

U.S. Pat. No. 7,260,852 by Sheetz circa 2007 discloses a "wraparound swimsuit;"

U.S. Pat. No. 8,491,555 by Bracci circa 2013 discloses an "absorbency pad for use in neonatal care and related methods of use," wherein nano silver fibers are mentioned in the document;

U.S. Pat. No. 8,973,793 by Aryan circa 2015 discloses an "infant support garment;"

U.S. D574,579 by Kang circa 2008 discloses the look and appearance of a "shirt;"

U.S. D672,137 by Jackson circa 2012 discloses an "infant care garment;"

U.S. D742,630 by Mullins circa 2015 discloses a "baby sleep support;"

US20060206978 by Hilton et al. circa 2006 discloses "medical garments for assisting in skin-to-skin holding of infants in neonatal intensive care units;"

US20080149674 by Hiniduma-Lokuge circa 2008 discloses an "infant carrier;"

US20090285872 by Labelle circa 2009 discloses an "amphibious carrier and method of manufacturing;"

US20130291279 by Jensen et al. circa 2013 discloses "garments and method for carrying a baby to provide skin-to-skin contact;"

US20140283277 by Wilhelm circa 2014 discloses a "medical wrap for neonatal kangaroo care;"

CN204379553U by 田东奎 circa 2015 discloses a "baby care device;" and,

CN202588350U by 许育硕 circa 2012 discloses "silver fiber baby clothes."

SUMMARY OF THE INVENTION

The primary impetus for the neonate medical wrap is the problem of baby drops at hospitals that implement skin-to-skin (baby's skin on mother's skin) neonatal care. In addition to baby drops, the wrap is designed to protect against cases of MRSA, VRE and nosocomial infections are also problematic during skin-to-skin infant care. In view of the foregoing, disclosed is a neonate medical wrap. In one embodiment, the neonate medical wrap is a wrap-style baby carrier that is particularly useful during the first 28 days after the baby's birth.

In a preferred embodiment, the neonate medical wrap comprises a torso sleeve and a shoulder strap. The shoulder strap and torso sleeve generally form concentric fabric loops or tubes and are joined along a mutual opening down the side of the tube. In a preferred embodiment, the opening is selectively closable via a zipper and features at least one (e.g., two) secondary clasp for added stability of the closed opening. In use, the torso sleeve and shoulder strap may be outfitted around the torso of a parent and, via the side opening, a baby may be installed against the parent's skin under the sleeve. The shoulder strap may be provided over the shoulder of the parent to assist in supporting the baby's weight while standing and, as a result, enable hands free skin-to-skin carrying of the baby inside the torso sleeve supported by the shoulder strap. Suitably, the torso sleeve can feature patterned compression threading for compressing arms and legs of the baby and for supporting the parents abdomen and back during use. Finally, the wrap suitably includes fibers that are bonded with a layer of 99% pure metallic silver threading knitted throughout to reduce the risk of infectious illnesses, including by inhibiting the growth of bacteria on the wrap.

The neonate medical wrap may suitably reduce any risk of infant injury, reduce risk of infant illness, and facilitate safe skin-to-skin or other hands-free coddling of the baby. Preferably, the wrap goes around the torso of a parent and features an opening on the side for easy baby installation into the wrap. Once installed inside the wrap, the baby (i.e., front of the baby) is suitably compressed against the parent. Compression may be facilitated via use of compression threading. Suitably, the wrap has a secondary strap or sling mechanism for added support and carrying security.

Suitably, the disclosed neonate medical wrap may be used in at least the following four (4) situations: 1. by a parent after vaginal delivery of a newborn baby; 2. by a parent after delivery of a baby via Cesarean Section ("C-section"); 3. by a parent while a baby is treated in a neonatal intensive care unit of a hospital; and 4. by a parent at home and a post-hospital setting. In a first example, immediately prior to vaginal delivery of a baby, a nurse or midwife may assist the mother-to-be in outfitting the neonate medical wrap prior to you start to child-birth so that the newborn baby may be quickly placed inside the wrap against the mothers skin. In a second example, before a C-section, a nurse or midwife may assist a mother-to-be in outfitting the wrap after a spinal anesthesia has been placed on the mother-to-be. Elaborating on the second example, the wrap may be placed on the delivery table so that, after the spinal anesthesia is placed and the mother-to-be laid down on table, the nurse or midwife may place the wrap on the mother. In both examples, early positioning of the wrap on the mother-to-be enables the wrap to acclimate to her body temperature whereby (after the baby is born, its umbilical cord is clamped, and its skin is wiped down) the garment can be partially uninstalled to place the newborn baby against the mother. In a third example, the wrap may be used in the NICU as well for kangaroo care. Continuing the third example, the garment can enable placement of the baby on a parent's upper chest while any medical tubes, lines, or other equipment can be managed while attached to the baby. It should be noted that the 99% pure metallic silver threading may be especially good in the NICU since the chance of contracting MRSA, VRE and nosocomial infections double after being treated in the NICU. In a fourth example, the neonate medical wrap can be used in the home after delivery of the baby, including after delivery for the first twenty-eight (28) days while the baby is in the neonate phase. In a preferred mode the baby may be in the range of weight between four (4) and fourteen (14) pounds (lbs).

Suitably, a baby will suitably be positioned with its body is fully aligned with the parents body on his or her chest (e.g., in a frog legged position where the baby's arms on its sides). In a preferred positioning, the baby is front-to-front (e.g., chest-to-chest) with the parent. In one embodiment, the baby's cheek may be positioned on the parent's chest in a position proximate to the parents chin and lips so that the parent is able to bend his or her neck down and kiss the baby's forehead. The secondary strap or sling may suitably be wrapped around the parent's torso or wrapped over the parent's shoulder for added support while sitting or lying in bed. While the baby is installed, the parent can suitably relax and recover in a substantially hands free manner while maintaining skin-to-skin contact with the baby at substantially all times.

Suitably, the wrap may also be worn in a standing position. Initially, after the wrap is outfitted as described above, a parent may tuck their arm into the shoulder strap to allow the shoulder strap to slide up the arm and over half of the shoulder. Preferably, the bottom part of the shoulder strap will support the underneath of the baby's buttocks and back. In one embodiment, the baby's weight can be well distributed across parent's back to maintain excellent posture and support without causing strain. Such positioning of the wrap can suitably enable a parent to walk freely with both hands substantially free, as well as (in the case of a mother) maintain proper post-pregnancy posture until her body has time to recover. Such positioning of the wrap can also allow a parent to have both hands substantially free to catch the baby in case of falls or to block projectile objects from contact with the baby. Suitably, a parent and baby can co-sleep (i.e., sleep together) in a bed where the wrap can prevent baby falls or baby suffocation from the bedding. A lactating parent can also breastfeed while wearing the garment.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

In the figures, the following components are represented by the corresponding reference numerals.

neonate medical wrap —1000;
torso sleeve —1100;
lower rim —1200;
upper rim —1300;
sweat band —1310
band —1400;
hook clasp —1410;
loop clasp —1420;
strap/sling —1500;
upper shoulder strap rim —1510;
lower shoulder strap rim —1520
pocket —1550;
pocket opening —1551;
pocket opening zipper 1552;
opening/zipper —1600;
zipper cover —1610;
compression threading —1800;
silver threading —1900;
parent —2000; and,
baby —3000.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is a neonate medical wrap. In one embodiment, the neonate medical wrap is a wrap-style baby carrier that is particularly useful during the first 28 days after the baby's birth. Generally, the disclosed neonate medical wrap comprises a torso wrap and a shoulder strap. In use, the torso wrap and shoulder strap may be outfitted around the torso of a parent and, via a side opening, a baby may be installed against the parent's skin under the torso wrap. The shoulder strap may be provided over the shoulder of the parent to assist in supporting the baby's weight while standing. The more specific aspects of the disclosed neonate wrap are disclosed in connection with the figures.

Figure 1:
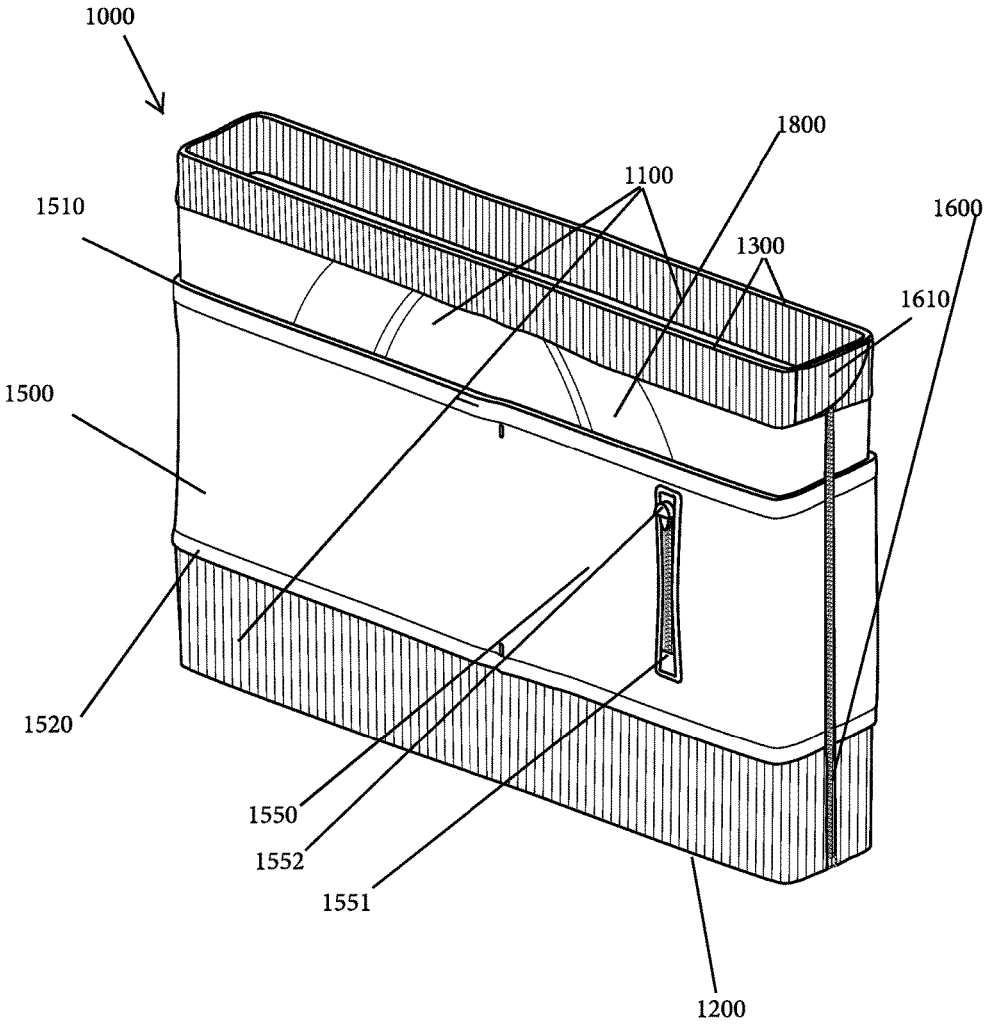
FIG. 1 is a perspective view of a preferred embodiment of a wrap 1000 in a closed configuration.
Figure 2:
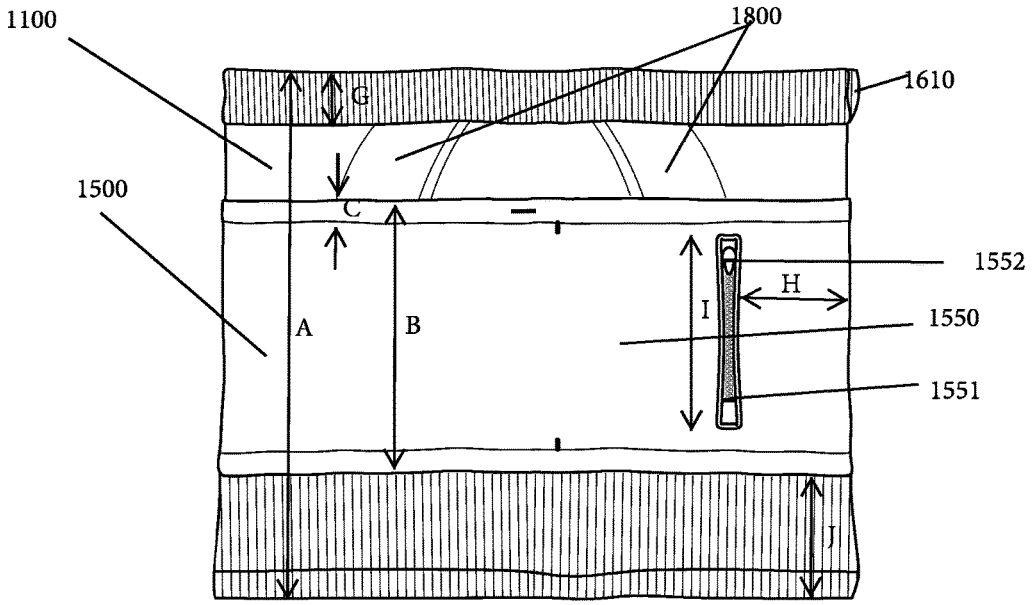
FIG. 2 is a front view of the wrap 1000 of FIG. 1.
Figure 3:
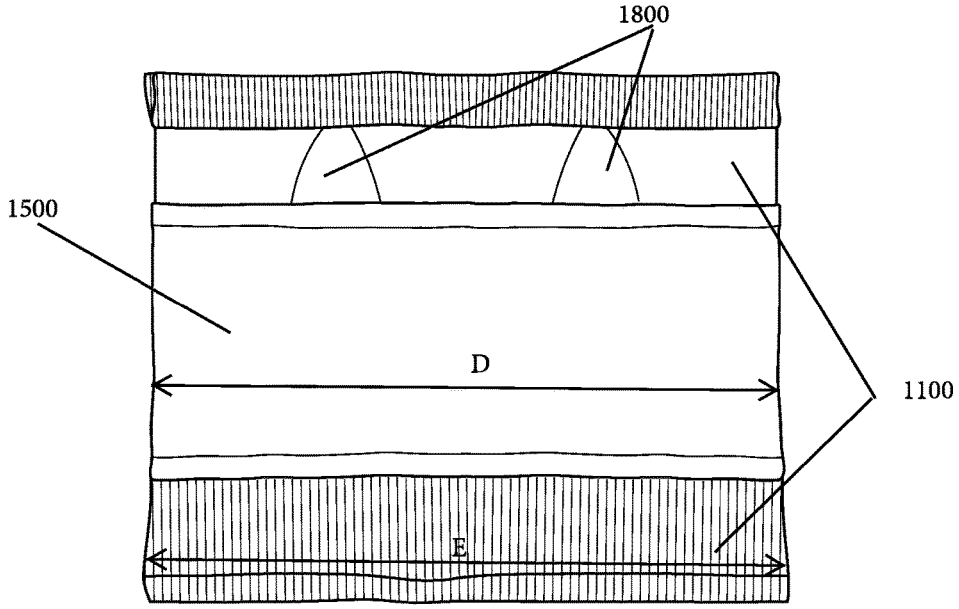
FIG. 3 is a rear view of the wrap 1000 of FIGS. 1 and 2.
Figure 4:
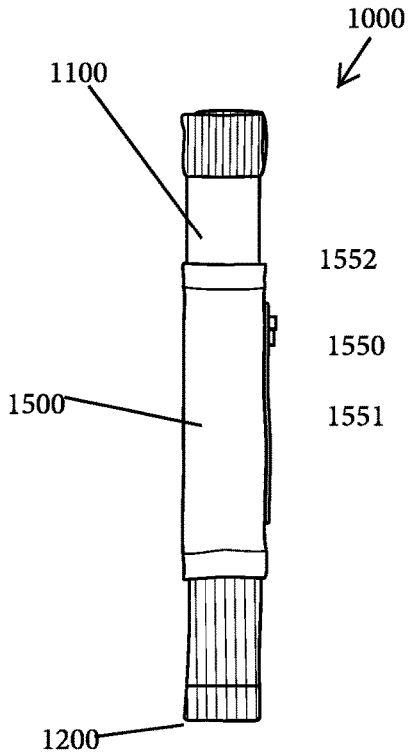
FIG. 4 is a right-side view of the wrap 1000 of FIGS. 1 through 3.
Figure 5:
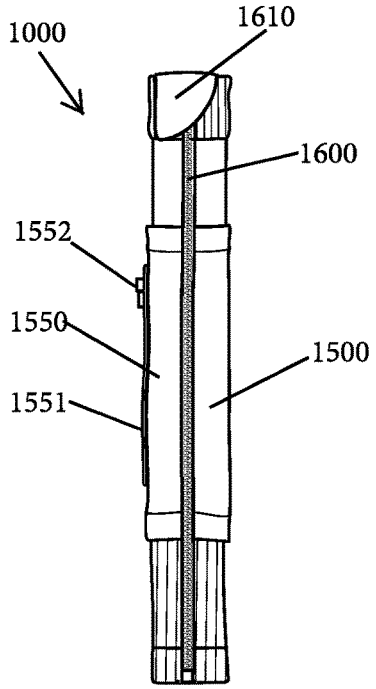
FIG. 5 is a left-side view of the wrap 1000 of FIGS. 1 through 4.
Figure 6:
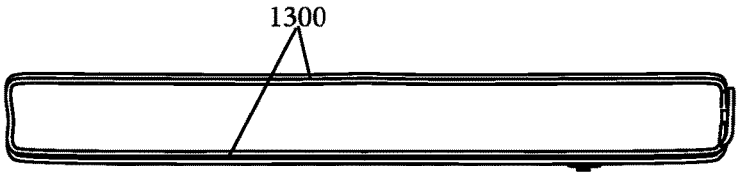
FIG. 6 is a top view of the wrap 1000 of FIGS. 1 through 5.
Figure 7:
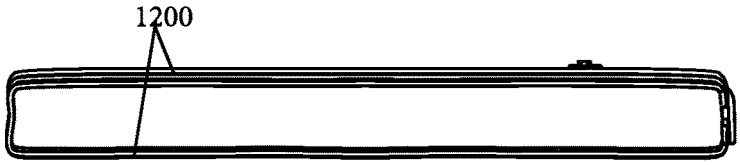
FIG. 7 is a bottom view of the wrap 1000 of FIGS. 1 through 6.
Figure 9:
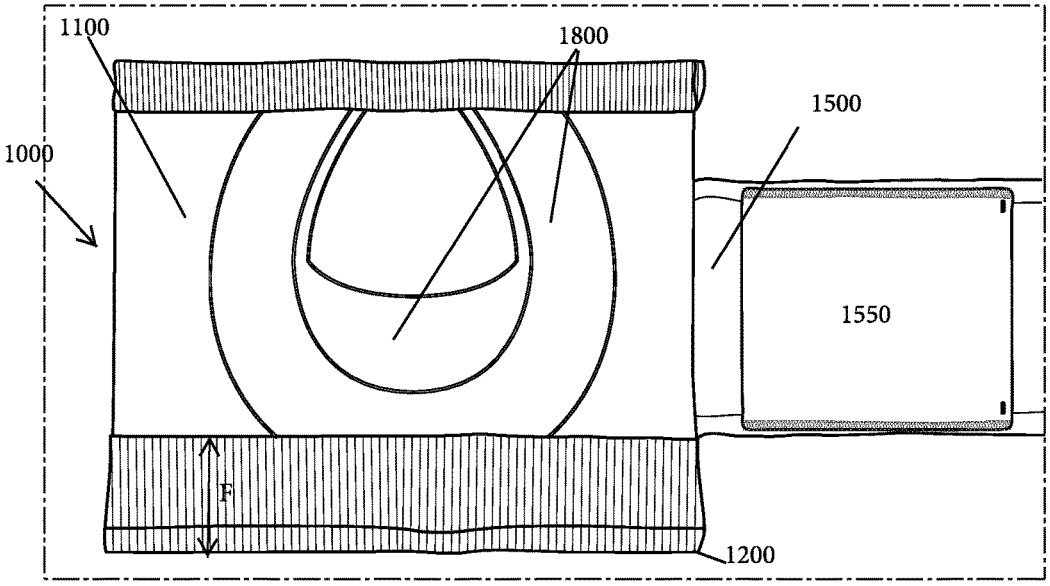
FIG. 9 is a front view of the wrap 1000 of FIGS. 1 through 8, where a strap 1500 is unfurled.
Figure 10:
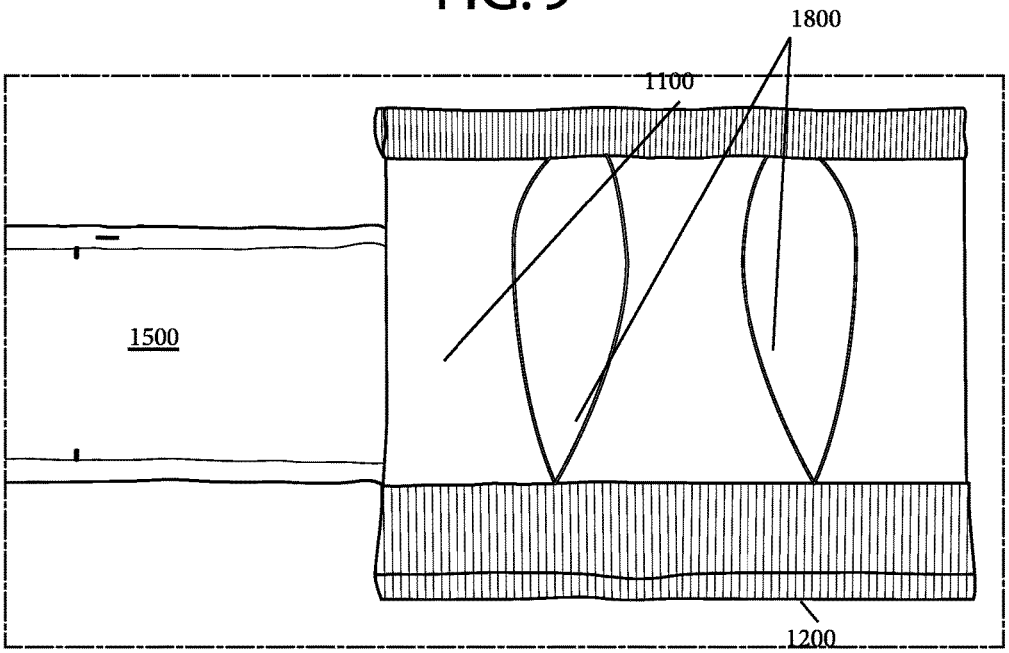
FIG. 10 is a rear view of the wrap 1000 of FIGS. 1 through 9, where the strap 1500 is unfurled.

FIG. 1 is a perspective view of a preferred embodiment of a wrap 1000 in a closed configuration. FIGS. 2 through 7 are the orthogonal views of the wrap 1000. Specifically, FIG. 2 is a front view of the wrap 1000; FIG. 3 is a rear view of the wrap 1000; FIG. 4 is a right-side view of the wrap 1000; FIG. 5 is a left-side view of the wrap 1000; FIG. 6 is a top view of the wrap 1000; and, FIG. 7 is a bottom view of the wrap 1000 of FIGS. 1 through 6. FIG. 9 is a front view and FIG. 10 is a rear view of the wrap 1000 of FIGS. 1 through 7, where the strap 1500 is unfurled (i.e., not joined as shown in FIGS. 1 through 7 so that the inside of the strap 1500 and outside of the sleeve 1100 can be seen.

Figure 13:
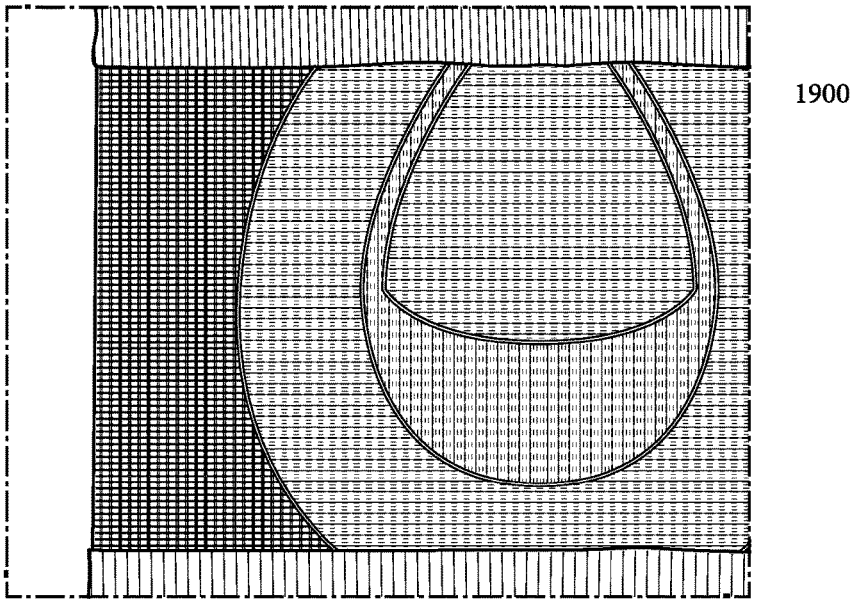
FIG. 13 is another zoom-in of the wrap 1000 of FIGS. 1 through 11 that shows compression threading 1800.

Referring to FIGS. 1 through 7, 9 and 10, the neonate medical wrap 1000 comprises: a torso sleeve 1100 and a shoulder strap 1500. The shoulder strap 1500 and torso sleeve 1100 generally form concentric fabric loops or tubes and are joined along a mutual opening 1600 down the side of the conjoined concentric tubes that defines the wrap 1000 (see FIG. 1). The tube formed by the sleeve 1100 features an upper rim 1300 and a lower rim 1200; the tube formed by the shoulder strap features an upper rim 1510 and a lower rim 1520. The shoulder strap 1500 features a pocket 1550 (seen best in FIG. 9) with a zippered 1552 opening 1551 for the retention of various baby related items (e.g., a binky (not shown) or face wipe (not shown)). As shown, the opening 1600 is preferably selectively closable via a zipper 1600 and features a secondary clasp 1400 (shown later in FIG. 11 since the secondary clasp 1400 is an internal component) for added stability of the closed opening 1600. In a preferred embodiment, the zipper head may be locked in place at the top rim 1300 of the sleeve 1100 via a zipper lock 1610 or flap that covers and holds the zipped-up configuration shown in FIG. 1. Suitably, the torso sleeve 1100 can feature patterned compression threading 1800 for compressing arms and legs of the baby (FIG. 9) and for supporting the parent's abdomen (FIG. 9) and back (FIG. 10) during use. A zoom-in view of the compression threading 1800 is shown in FIG. 13.

Figure 8:
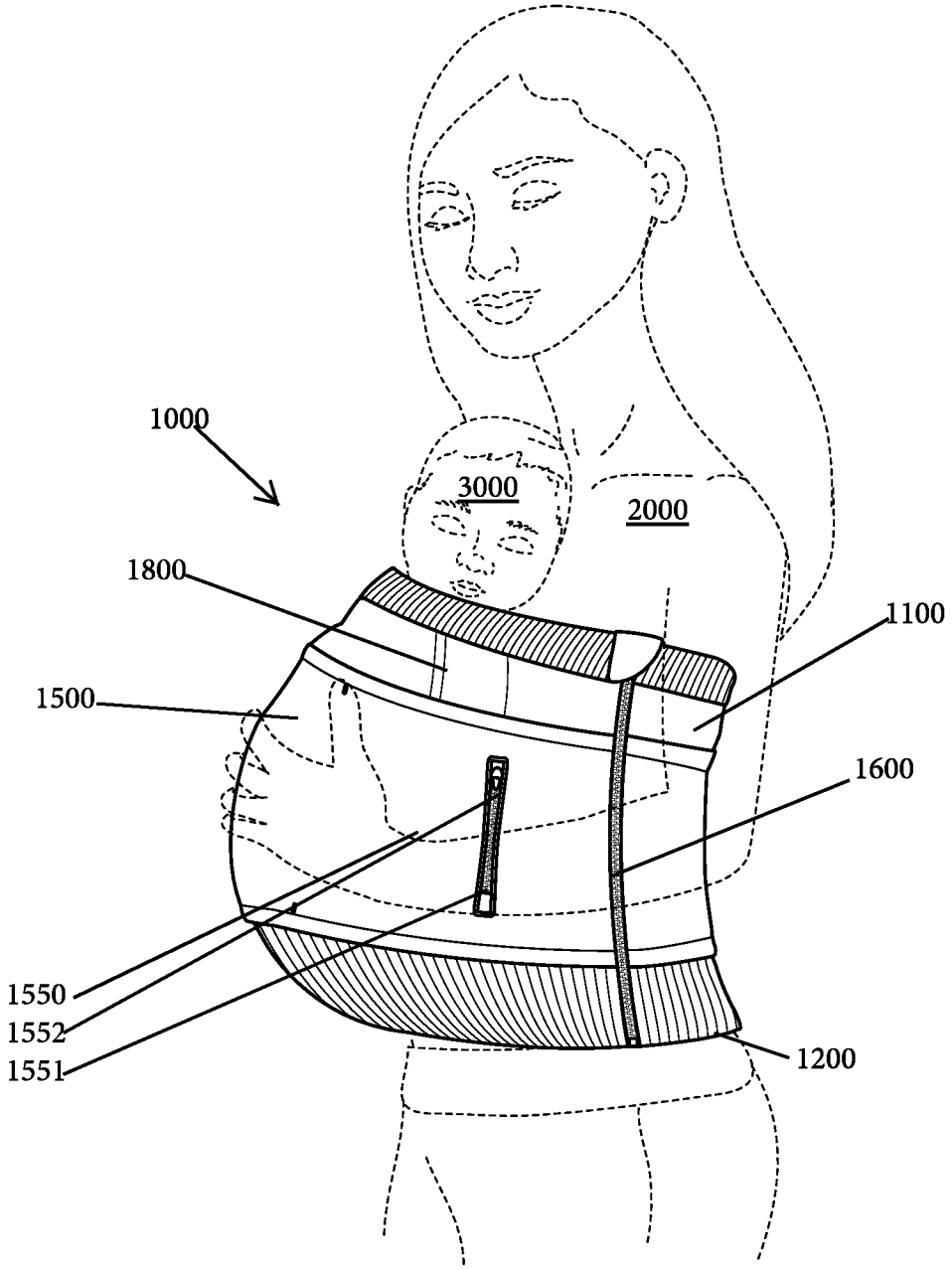
FIG. 8 is an environmental view of the wrap 1000 of FIGS. 1 through 7.
Figure 11:
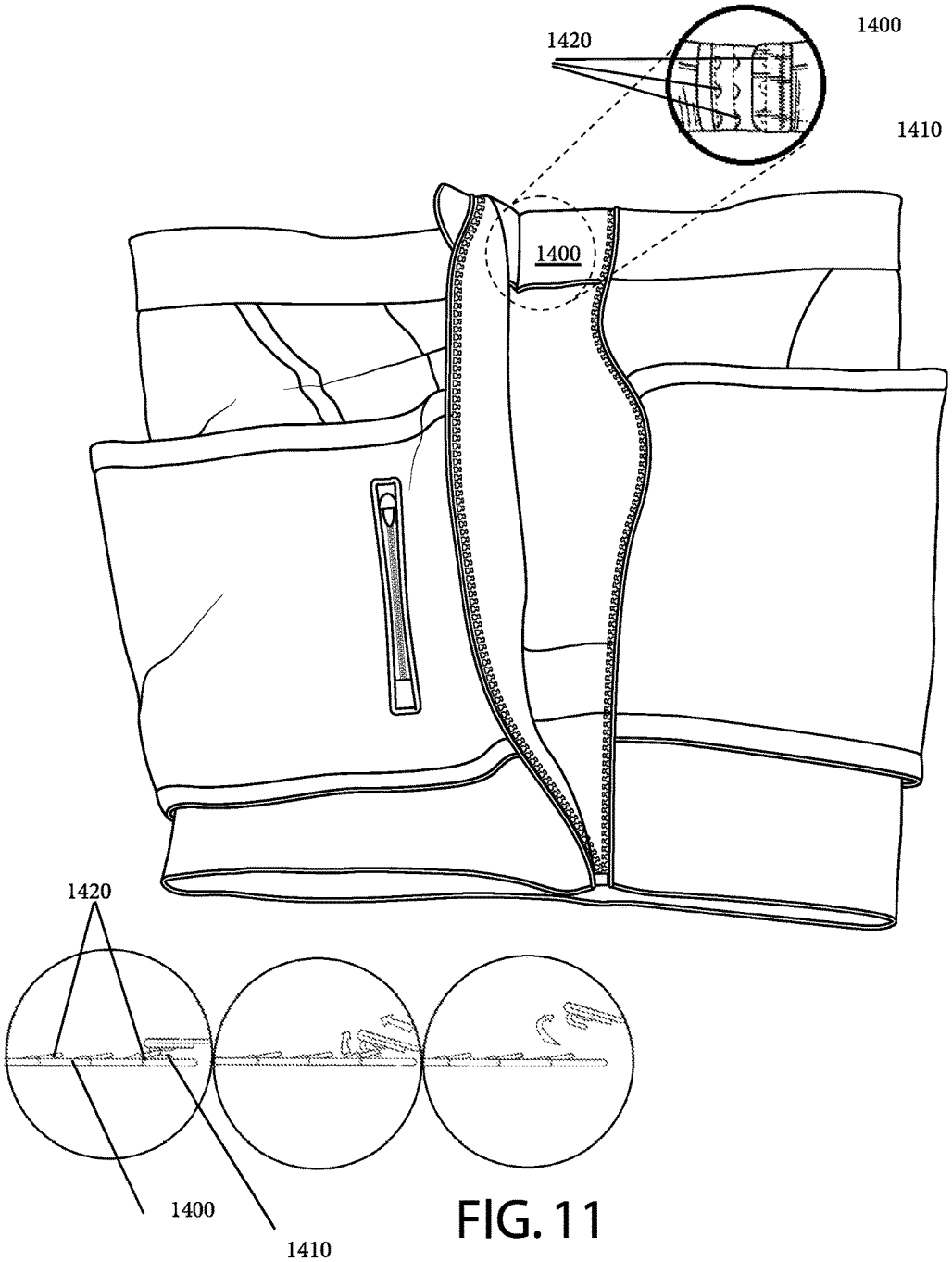
FIG. 11 is a side view of the wrap 1000 of FIGS. 1 through 10, where the wrap 1000 is being opened via a zipper 1600.

FIG. 8 is an environmental view of the wrap 1000 of FIGS. 1 through 7. FIG. 11 is a side view of the wrap 1000 of FIGS. 1 through 10, where the wrap 1000 is being opened via a zipper 1600. Preferably, the wrap 1000 goes around the torso of a parent 2000 and features an opening 1600 on the side for easy baby 3000 installation into the wrap 1000. As shown in FIGS. 8 and 11, the torso sleeve 1100 and shoulder strap 1500 may be outfitted around the torso of a parent 2000 and, via the side opening 1600, a baby 3000 may be installed against the parent's 2000 skin within the sleeve 1100. As shown, the shoulder strap 1500 may be provided over the baby 3000 for added support and compression. Suitably, the wrap has two (2) secondary claps 1400 or band that increases the stability of the opening 1600 so that it is reinforced during use. Suitably, the secondary clasp may be defined by a band 1400 with a hook clasp 1410 and a loop clasp 1420. Suitably, the secondary claps may be closed by coupling the hook clasp and loop clasp shown in the blowout circles of FIG. 11. Once installed inside the wrap, the baby is suitably compressed against the parent. Compression may be facilitated via use of compression threading 1800 and the back may be supported by the rear compression threading 1800.

Figure 12:
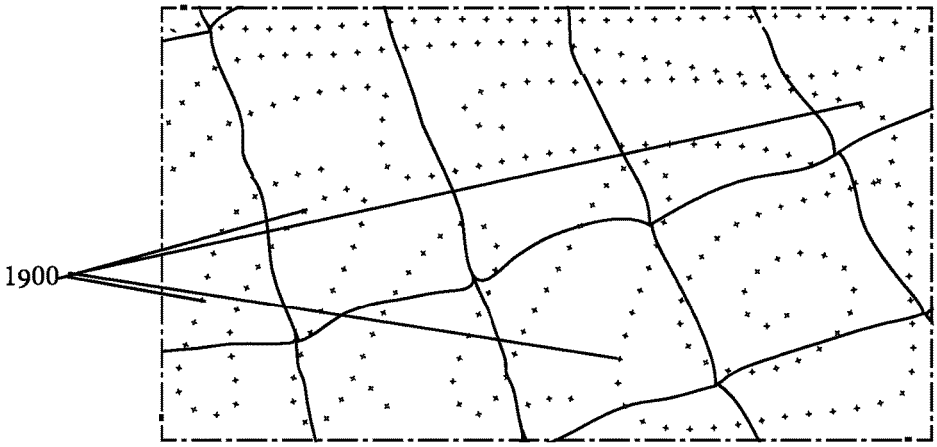
FIG. 12 is a zoom-in view of the wrap 1000 of FIGS. 1 through 11 that shows 99% pure metallic silver threading 1900.

The disclosed neonate medical wrap 1000 may suitably reduce the risk of infant 3000 injury, reduce the risk of infant 3000 illness, and facilitate safe skin-to-skin or other hands-free coddling of the baby 3000. To this end, the wrap 1000 may have bonded fibers (including permanently bonded fibers) with a layer of 99% pure metallic silver threading 1900 knitted throughout to reduce the risk of infectious illnesses. FIG. 12 is a zoom-in view of the wrap 1000 of FIGS. 1 through 11 that shows 99% pure metallic silver threading 1900. In a preferred embodiment, the 99% pure metallic sliver threading can be acquired under the trade-name Xstatic® silver.

FIGS. 2, 3, and 9 illustrate various preferred dimensions of the disclosed neonatal medical wrap 1000. Dimension A is a measure from the top edge 1300 finish to the bottom edge finish 1200 of the sleeve 1100. In preferred embodiments, the dimension A may be fifteen (15) inches, fourteen and one-half (14.5) inches, or fourteen and one-quarter (14.25) inches. Dimension B is a measure from the top edge 1510 to the bottom edge 1520 of the shoulder strap 1500. In preferred embodiments, the dimension B may be seven and one-half (7.5), seven and seven-eighths (7⅞) inches, or eight (8) inches. Dimension C is a measure from the shoulder strap 1500 stitching line straight up to the top edge 1510 of the shoulder strap 1500. In preferred embodiments, the dimension C is one-half (½) inch. Dimension D is a measure of the shoulder strap 1500 folded in half (e.g., the length of a preferred embodiment of the shoulder strap 1500 may be two times the dimension D). In preferred embodiments, the dimension D is eighteen and one-half (18.5) inches, or eighteen and five-eighths (18⅝) inches. Dimension E is a measure of the sleeve 1100 folded in half (e.g., the length of a preferred embodiment of the sleeve 1100 may be two times the dimension E). In preferred embodiments, the dimension E is eighteen and one-half (18.5) inches, or eighteen and five-eighths (18⅝). Dimension F is a measure from the bottom edge 1200 of the sleeve 1100 to the start of the compression threading 1800. In preferred embodiments, the dimension F may be three (3) inches or two and seven eighths (2⅞) inches. Dimension G may be a measure of the top 1300 stitching. In preferred embodiments, the dimension G may be one and one-half (1.5) inch. Dimension H may be the measure between the opening 1600 and the opening 1551 of the pocket 1550. In preferred embodiment, the dimension H may be two (2) inches or two and one eighth (2⅛) inches. Dimension I may be the dimension of the opening 1551. In preferred embodiments, the dimension I may be five and one-fourth (5.25) inch. Dimension J may be the distance between the bottom 1200 of the sleeve 1100 and the bottom 1520 of the shoulder strap 1500. In preferred embodiments, the dimension J is three and one half (3.5) inches or three and five-eighths inches. All dimensions can be plus or minus a half (½) inch.

Figure 14:
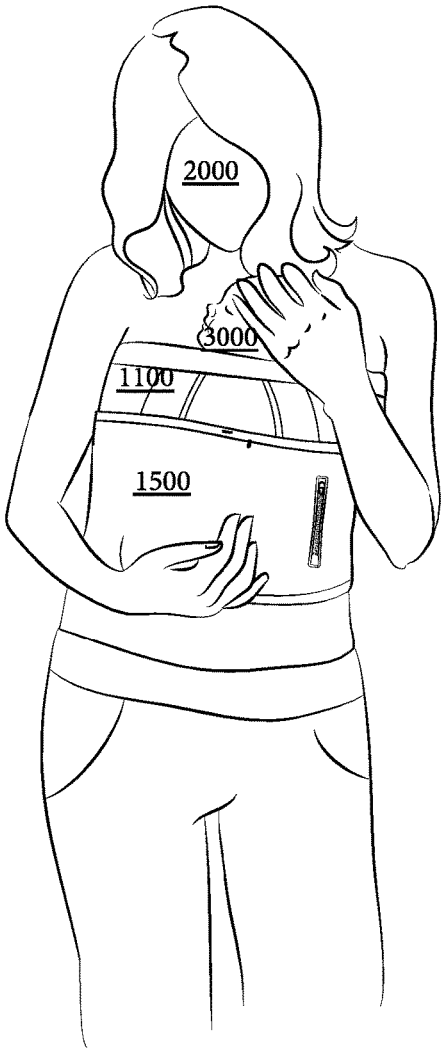
FIG. 14 is an environmental view of the wrap 1000 of FIGS. 1 through 13, where the strap 1500 is around the torso of a parent 2000.
Figure 15:
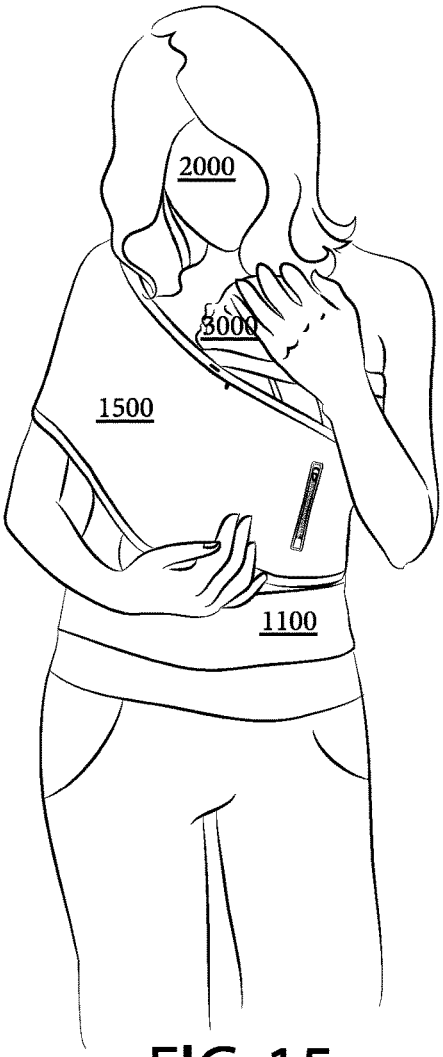
FIG. 15 is another environmental view of the wrap 1000 of FIGS. 1 through 13, where the strap 1500 is over the shoulder of the parent 2000.
Figure 16:
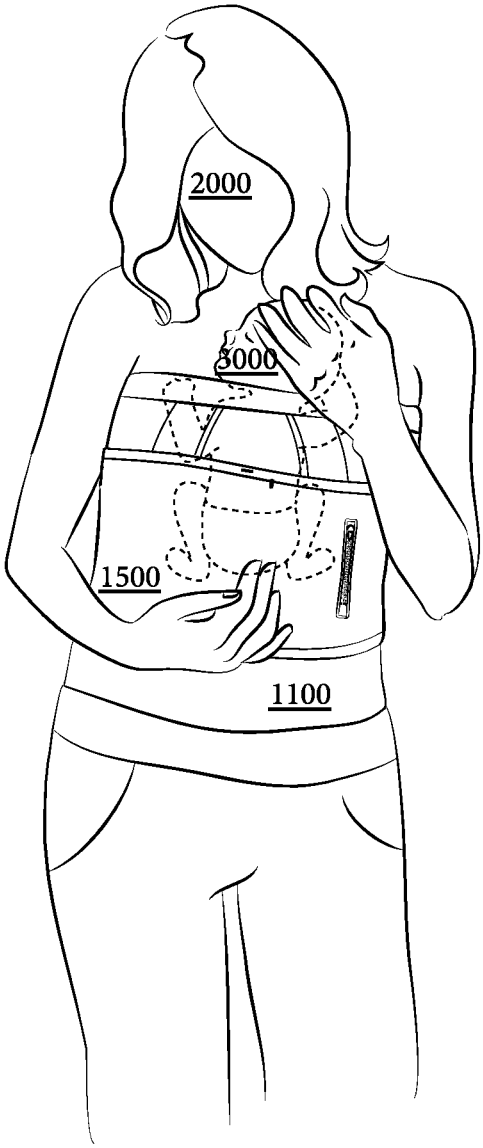
FIG. 16 is yet another environmental view of the wrap 1000 of FIGS. 1 through 13, where the strap 1500 is around the torso of the parent 2000 while the baby 3000 is positioned in a frog pose.

Suitably, the disclosed neonate medical wrap may be used in at least the following four (4) situations: 1. by a parent after (including immediately after) vaginal delivery of a newborn baby; 2. by a parent after (including immediately after) delivery of a baby via Cesarean Section ("C-section"); 3. by a parent while a baby is treated in a neonatal intensive care unit of a hospital; and 4. by a parent at home and a post-hospital setting, including for the first twenty-eight (28) days after the baby's birth. FIG. 14 is an environmental view of the wrap 1000 of FIGS. 1 through 13, where the strap 1500 is around the torso of a parent 2000. FIG. 15 is another environmental view of the wrap 1000 of FIGS. 1 through 13, where the strap 1500 is over the shoulder of the parent 2000. FIG. 16 is yet another environmental view of the wrap 1000 of FIGS. 1 through 13, where the strap 1500 is around the torso of the parent 2000 while the baby 3000 is positioned in a frog pose. FIG. 17 is a zoom-in of a baby 3000 in the wrap 1000.

Figure 17A:
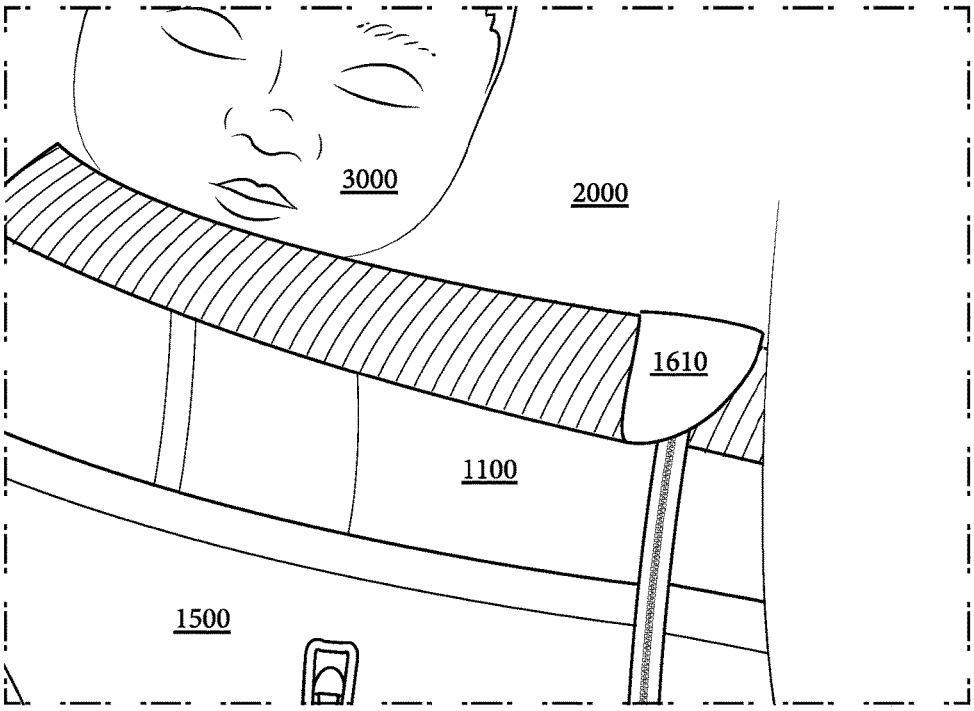
FIG. 17A is a zoom-in of a baby 3000 in the wrap 1000.
Figure 17B:
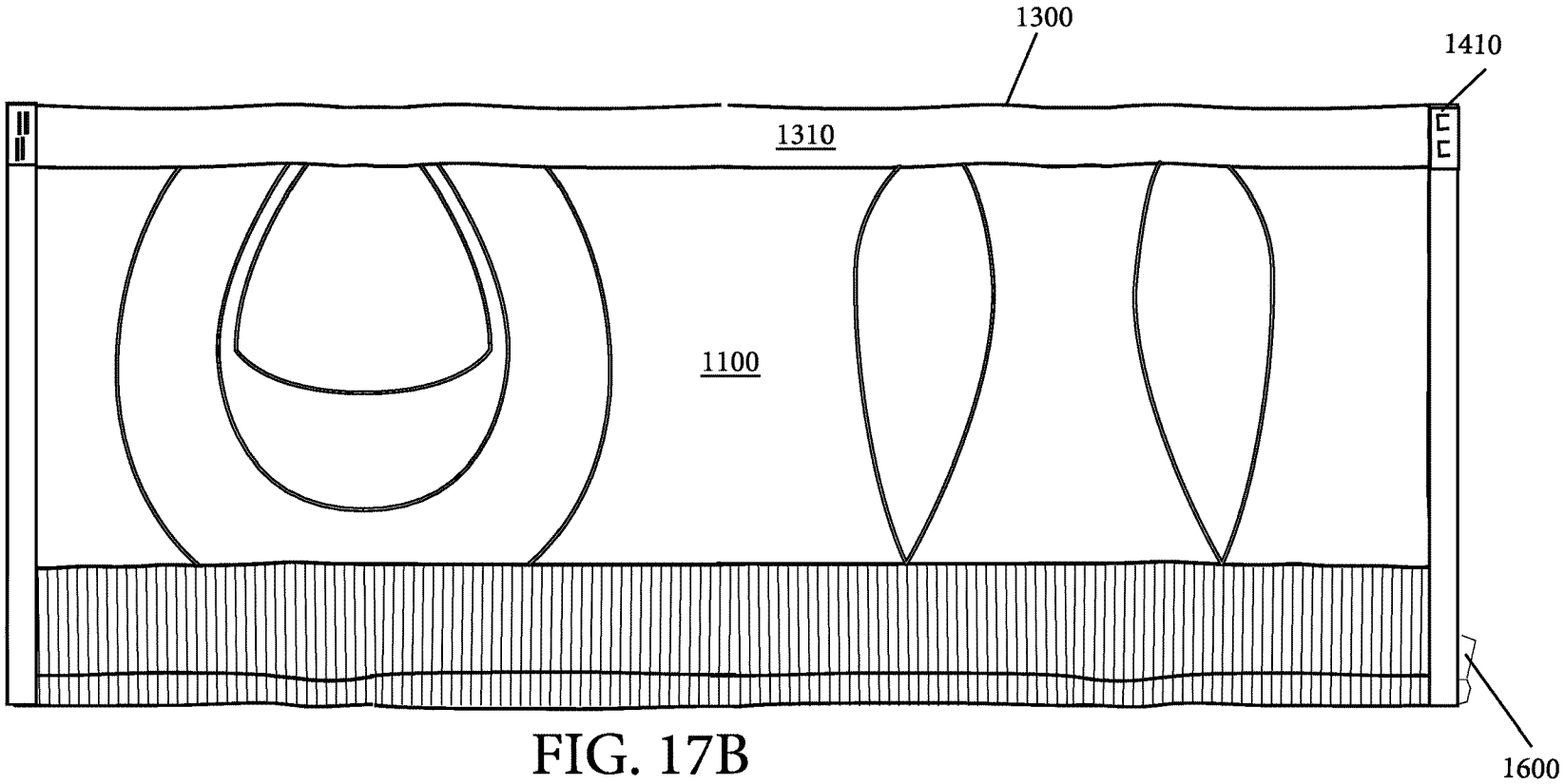
FIG. 17B is an inside view of the wrap 1000 of FIGS. 1 through 17A.

Suitably, a baby 3000 may be positioned so that its body is fully aligned with the parent's 2000 body on his or her chest (e.g., in a frog legged position where the baby's arms on its sides (see FIG. 16)). In one embodiment shown in FIG. 17, the baby's 300 cheek may be positioned on the parent's 2000 chest in a position proximate to the parents chin and lips (not shown in FIG. 17) so that the parent 2000 is able to bend his or her neck down and kiss the baby's 3000 forehead. FIG. 17B is an inside view of the wrap 1000 of FIG. 17A. Referring to FIGS. 17A and 17B, the wrap 1000 may feature a sweatband 1310 along the upper rim 1300 for the length the wrap 1000 when unfurled with the zipper 1600 undone (as shown in FIG. 17B). Suitably, the sweat band 1310 (a) is configured to help with placement of the wrap 1000 so that it is restricted from movements and (b) is further configured to provide softness to an infant's 3000 head and cheek (see FIG. 17A).

As shown in FIG. 14 or 15, the secondary shoulder strap or sling 1500 may suitably be wrapped around the parent's 2000 torso (FIG. 14) or wrapped over the parent's 2000 shoulder (FIG. 15) for added support while sitting or lying in bed. While the baby 3000 is installed, the parent 2000 can suitably relax and recover in a substantially hands-free manner while maintaining skin-to-skin contact with the baby at substantially all times.

Suitably, the wrap 1000 may also be worn in a standing position. Initially, after the wrap 1000 is outfitted as described above, a parent 2000 may tuck their arm into the shoulder strap 1500 to allow the shoulder strap 1500 to slide up the arm and over half of the shoulder (FIG. 15). Preferably, the bottom part 1520 of the shoulder strap 1500 will support the underneath of the baby's 3000 buttocks and back. In one embodiment, the baby's weight can be well distributed across parent's 2000 back to maintain excellent posture and support without causing strain. Such positioning of the wrap 1000 can suitably enable a parent 2000 to walk freely with both hands substantially free, as well as (in the case of a mother) maintain proper post-pregnancy posture until her body has time to recover. Such positioning of the wrap can also allow a parent to have both hands substantially free to catch the baby in case of falls or to block projectile objects (not shown) from contact with the baby 3000. Suitably, a parent and baby can co-sleep (i.e., sleep together) in a bed where the wrap can prevent baby falls or baby suffocation from the bedding. A lactating parent 3000 can also breastfeed while wearing the garment.

FIGS. 8 and 14 through 17 and the following examples further illustrate these uses.

EXAMPLE 1—Vaginal Delivery of a Newborn

In a first example, immediately prior to vaginal delivery of a baby 2000, a nurse or midwife (not shown) may assist the mother-to-be 3000 in outfitting the neonate medical wrap 1000 prior to the start of child-birth so that the newborn baby 3000 may be quickly placed inside the wrap 1000 against the mothers skin 1000, as shown.

EXAMPLE 2—C-Section Delivery of a Newborn

In a second example, before a C-section, a nurse or midwife (not shown) may assist a mother-to-be 2000 in outfitting the wrap 1000 after a spinal anesthesia (not shown) has been placed on the mother-to-be 2000. Elaborating on the second example, the wrap 1000 may be placed on the delivery table (not shown) so that, after the spinal anesthesia (not shown) is placed and the mother-to-be 2000 laid down on table (not shown), the nurse or midwife (not shown) may place the wrap 1000 on the mother 2000.

In both examples 1 and 2, early positioning of the wrap 1000 on the mother-to-be 2000 enables the wrap 1000 to acclimate to her 2000 body temperature whereby (after the baby 3000 is born, its umbilical cord (not shown) is clamped, and its skin is wiped down) the garment 1000 can be partially uninstalled (see FIG. 11) to place the newborn baby 2000 against the mother 2000. Once the baby 2000 is placed against the mother, then the claps can be reinstalled and the zipper fully zipped plus placed in a locked position.

EXAMPLE 3—NICU Use Up to Twenty-Eight Days Post Delivery

In a third example, the wrap 1000 may be used in the NICU as well for kangaroo care. Continuing the third example, the garment 1000 can enable placement of the baby 3000 on a parent's 2000 upper chest while any medical tubes (not shown), lines (not shown), or other equipment (not shown) can be managed while attached to the baby 3000. It should be noted that the 99% pure metallic silver threading 1900 may be especially good in the NICU since the chance of contracting MRSA, VRE and nosocomial infections double after being treated in the NICU.

EXAMPLE 4—At Home Use

In a fourth example, the neonate medical wrap can be used in the home after NICU use, including for use on a baby during the first twenty-eight (28) days after birth.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

PAPER "SEQUENCE LISTING"

Not applicable.

We claim:

1. A neonate medical wrap comprising:

a torso sleeve that can be outfitted around a torso of a mother and a baby of the mother while the baby and mother are in a chest-to-chest position and in skin-to-skin contact with each other;

a shoulder strap that can extend over a shoulder of the mother;

wherein the shoulder strap and torso sleeve form concentric fabric tubes prior to the shoulder strap being extended over the shoulder of the mother;

wherein the shoulder strap and torso sleeve are joined along a mutual opening down a conjoined side of the shoulder strap and torso sleeve;

wherein the tube formed by the sleeve features a first upper rim, a first lower rim, a first pattern of compression threading that is located between the first upper rim and first lower rim to compress limbs of the baby, and a second pattern of compression threading that is located between the first upper rim and first lower rim to compress a back-side of the torso of the mother;

wherein the tube formed by the shoulder strap features a second upper rim and a second lower rim;

wherein the sleeve and shoulder strap can be around both the torso of the parent and a body of the baby and so that the head of the baby is exposed at the upper rim of the torso sleeve, at least one limb of the baby is compressed by the first pattern of compression threading, and the back torso of the wearer is compressed by the second pattern of compression threading wherein the shoulder strap features a pocket for the retention of items;

wherein the mutual opening down the side of the conjoined concentric tubes is selectively closable via a zipper and further wherein a secondary clasp is provided to the mutual opening at an internal portion of the first upper rim;

wherein the zipper has a zipper head that is locked in place at an external portion of the first upper rim via a zipper lock or flap that covers and holds the zipper head whereby the zipper of the mutual opening retains a zipped-up configuration; and, wherein the secondary clasp is defined on a side of the mutual opening by a band with a hook clasp and on another side of the mutual opening by a loop clasp, closed by coupling the hook clasp and loop clasp, and operates to reinforce the zipper in the zipped-up configuration.

2. The neonate medical wrap of claim 1 wherein the torso sleeve features silver threading.

3. A method of securing a baby, the method comprising the steps of:

a. placing a neonate medical wrap around the torso of a parent, where the neonate medical wrap comprises:

a torso sleeve;

a shoulder strap;

wherein the shoulder strap and torso sleeve form conjoined fabric loops or tubes;

wherein the shoulder strap and torso sleeve are joined along a mutual opening down the side of the concentric loops or tubes, wherein the loop or tube formed by the torso sleeve features an upper rim and a lower rim and wherein the sleeve has a first pattern of compression threading and a second pattern of compression threading; and, wherein the loop or tube formed by the shoulder strap features an upper rim and a lower rim;

b. opening the mutual opening by taking a zipper head out of a flap that is covering the zipper head, pulling the zipper head to unzip a zipper, and unclasping a hook clasp from a loop clasp to unclasp a secondary clasp;

c. placing a baby within both the torso sleeve and shoulder strap on a bare chest of the parent; and d. closing the mutual opening:

by clasping the hook clasp to the loop clasp to close the secondary clasp, pulling the zipper head to zip the zipper, and covering the zipper head with the flap; and, so that the sleeve and shoulder strap are around both the torso of the parent and a body of the baby and so that the head of the baby is exposed at the upper rim of the torso sleeve, at least one limb of the baby is compressed by the first pattern of compression threading, and the back torso of the wearer is compressed by the second pattern of compression threading.

4. The method of claim 3, further comprising the step of:

e. positioning a portion of the upper rim of the shoulder strap over the shoulder of the parent while at least a portion of the lower rim of the shoulder strap is positioned under a buttocks of the baby.

* * * * *